US005120702A

United States Patent [19]

Minami et al.

[11] Patent Number: 5,120,702

[45] Date of Patent: Jun. 9, 1992

[54] HEAT-SENSITIVE RECORDING MATERIAL

[75] Inventors: Toshiaki Minami; Tadakazu Fukuchi; Toshio Kaneko, all of Tokyo, Japan

[73] Assignee: Jujo Paper Co., Ltd., Tokyo, Japan

[21] Appl. No.: 553,330

[22] Filed: Jul. 17, 1990

[30] Foreign Application Priority Data

Jul. 26, 1989 [JP] Japan ..... 1-193382

[51] Int. Cl.[5] ..... B41M 5/30

[52] U.S. Cl. ..... 503/209; 503/216; 503/217

[58] Field of Search ..... 427/150-151; 503/208, 209, 216, 217, 225

[56] References Cited

U.S. PATENT DOCUMENTS 4,771,033 9/1988 Shimizu et al. ..... 503/209

4,895,828 1/1990 Yaguchi et al. ..... 503/226

*Primary Examiner*—Bruce H. Hess

*Attorney, Agent, or Firm*—Sherman and Shalloway

[57] ABSTRACT

A heat-sensitive recording material has a support and a color-developing layer which comprises as an organic color-developing agent 4-hydroxy-4'-n-propoxydiphenylsulfone and as a stabilizer a particular stabilizer.

This heat-sensitive recording material is suitable for a high density-and speed-recording and is superior in the thermal preservability.

7 Claims, No Drawings

HEAT-SENSITIVE RECORDING MATERIAL

BACKGROUND OF THE INVENTION

1. Field of the Invention

The present invention relates to a heat-sensitive material which is suitable for the recording at a high density and high speed and which is superior in the thermal preservability.

2. Prior Art

In general, a heat-sensitive recording sheet is produced by applying a support, such as paper, synthetic paper, film, plastic, etc., a coating material which is prepared by individually grinding and dispersing a colorless chromogenic dyestuff and an organic color-developing agent, such as phenolic material, etc., into fine particles, mixing the resultant dispersion with each other and then adding thereto binder, filler, sensitizer, slipping agent and other auxiliaries. The coating material, when heated, undergoes instantaneously a chemical reaction which forms a color. These heat-sensitive recording materials have now been found in a wide range of application, including industrial measurement recorders, terminal printers of computer, facsimile equipment, automatic ticket vending machines, printer for barcode label, etc. In recent years, as the application of such recording is diversified and the performance of such recorders is enhanced, high qualities are required for heat-sensitive recording materials. For example, even with small heat energy in a high speed recording, the clear image with a high density is required.

However, the color formation with the small heat energy satisfying the above requirements sometimes brings about a serious problem. For example, the barcode label of a heat-sensitive recording material, which is widely used in supermarkets, etc., loses its function owing to the color-formation of the whole heat-sensitive layer of the label in the case the label is applied to a fried food such as fat-fried food. There is a contradiction that the above practical problem occurs easily with the increased color-forming ability in a small-heat energy. Under the above conditions, the color-formation with a small heat energy and the color-formation in the application of the label to a product under a high temperature are researched.

As a result, the following conclusion was obtained. The two color-formations are different from one another, i.e. the former corresponds to the so-called dynamic color-formation with an instantaneous heat-energy and the latter corresponds to a very specific case in the so-called static color-formation caused by a long contact with a high temperature-substance.

The heat in fried foods, etc. is transferred through a lap film and a support of thermal-sensitive label to the heat-sensitive layer, wherein the temperature of fried foods is usually at most 80° C. in the lapse of excess-oil removal. However, the heat-sensitive layer is colored due to a long contact period with the heat.

SUMMARY OF THE INVENTION

It is the main object of the present invention to provide a heat-sensitive recording material which has a superior color-formation under applying an instantaneous heat energy of high temperature and which is difficult in forming a color under the long contact with a heated substance of relatively low temperature, that is, a heat-sensitive recording material which has a high sensitivity in the dynamic color-formation and which has a low sensitivity in the static color-formation under the specific condition.

The above-mentioned object can be performed by a heat-sensitive recording material having on a substrate a heat-sensitive color-developing layer comprising a combination of a particular organic color-developing agent and a particular stabilizer. That is, the heat-sensitive recording material has on a substrate a heat-sensitive color-developing layer comprising a colorlss or pale colored basic chromogenic dyestuff and an organic color-developing agent, wherein 4-hydroxy-4'-n-propoxy diphenyl sulfone is used as an organic color-developing agent and at least one phenolic compound selected from the group consisting of the following substances is used as a stabilizer in the color-forming layer: bis(3-t-butyl-4-hydroxy-6-methylphenyl) sulfone, 4,4'-sulfinyl-bis(2-t-butyl-5-methylphenol), 4,4'-butylidene-bis(3-methyl-6-t-butylphenol), 1,1,3-tris(2-methyl-4-hydroxy-5-butylphenyl)butane, 1,1,3-tris(2-methyl-4-hydroxy-5-cyclohexylphenyl)butane and bis(3,5-dibromo-4-hydroxyphenyl) sulfone.

The colorless basic dyestuff used in the present invention is not limited. However, triphenylmethane type-, fluorane type-, azaphthalide type-and fluorene type-leuco dystuffs are preferable and include, for example:

TRIPHENYLMETHANE TYPE LEUCO DYESTUFFS 3,3-bis(p-dimethylaminophenyl)-6-dimethlamino-phthalide(Crystal violet lactone)

FLUORANE TYPE LEUCO DYESTUFF 3-diethylamino-6-methyl-7-anilinofluorane,
3-(N-ethyl-p-toluidino)-6-methyl-7-anilinofluorane,
3-(N-ethyl-N-isoamylamino)-6-methyl-7-anilinofluorane,
3-N-n-dibutylamino-6-mithyl-7-anilinofluorane,
3-diethylamino-6-methyl-7-(o,p-dimethylanilino)fluorane,
3-pyrolidino-6-methyl-7-anilinofluorane,
3-piperidino-6-methyl-7-anilinofluorane,
3-(N-cyclohexyl-N-methylamino)-6-methyl-7-anilinofluorane,
3-diethylamino-7-(m-trifluoromethylanilino)fluorane,
3-N-n-dibutylamino-7-(o-chloroanilino)fluorane,
3-(N-ethyl-N-tetrahydrofurfurylamino)-6-methyl-7-anilinofluorane,
3-dibutylamino-6-emthyl-7-(o,p-dimethylanilino)fluorane,
3-(N-methyl-N-propylamino)-6-methyl-7-anilinofluorane,
3-diethylamino-6-chloro-7-anilinofluorane,
3-diethylamino-7-(o-chloroanilino) fluorane,
3-diethylamino-7-(o-chloroanilino) fluorane,
3-diethylamino-6-methyl-chlorofluorane
3-diethylamino-6-methyl-fluorane,
3-cyclohexylamino-6-chlorofluorane,
3-diethylamino-benzo(a)-fluorane

AZAPHTHALIDE TYPE LEUCO DYESTUFFS 3-(4-diethylamino-2-ethoxyphenyl)-3-(1-ethyl-2-methylindol-3-yl)-4-azaphtahalide,
3-(4-diethylamino-2-ethoxyphenyl)-3-(1-ethyl-2-methylindol-3-yl)-7-azaphthalide,
3-(4-diethylamino-2-ethoxyphenyl)-3-(1-octyl-2-methylindol-3-yl)-4-azaphtahalide, 3-(4-N-cyclohexyl-N-methylamino-2-methoxyphenyl)-3-(1-ethyl-2-methylindol-3-yl)-4-azaphtalide.

FLUORENE TYPE LEUCO DYESTUFFS 3,6,6'-tris(dimethylamino) spiro (fluorene-9,3'-phthalide), 3,6,6'-tris(diethylamino)spiro(fluorene-9,3'-phthalide)

The above dyestuffs can be used alone or in combination.

The heat-sensitive recording material of the present invention used as an organic color-developing agent 4-hydroxy-4'-n-propoxydiphenylsulfone which forms a color through the melting reaction with the above dyestuff. 4-hydroxy-4'-n-propoxy-dipenylsulfone, the organic color-developing agent of the present invention, is a color-developing agent having a particular ability, chosen from the monoether-compounds of 4,4'-bisphenol sulfones as well-known color-developing agents. The effects of the present invention are not obtained in case of using the monoether compound of 4,4'-bisphenol sulfone other than that of the present invention.

The heat-sensitive recording material comprises a combination of the above particular color-developing agent and the particular stabilizer. Any of the stabilizers used in the present invention is a phenolic substance having both a melting point of at least 180° C. and a solubility of less than 0.05 g per 100 g water.

The effects of the present invention are not obtained in case of using a phenolic substance having a melting point of less than 180° C. or a solubility of at least 0.05 g per 100 g water, in combination with 4-hydroxy-4'-n-propoxy-diphenylsulfone as an organic color-developing agent of the present invention.

As the binders of the present invention, there can be mentioned, for example, a fully saponified polyvinyl alcohol having a polymerization degree of 200-1900, a partially saponified polyvinyl alcohol, carboxylated polyvinyl alcohol, amide-modified polyvinyl alcohol, sulfonic acid-modified polyvinyl alcohol, butyral-modified polyvinyl alcohol, other modified polyvinyl alcohol, hydroxyethyl cellulose, methyl cellulose, carboxymethyl cellulose, styrene/maleic acid anhydride copolymers, styrene/butadiene copolymers, cellulose derivatives such as ethyl cellulose, acetyl cellulose, etc., polyvinyl chloride, polyvinyl acetate, polyacryl amide, polyacrylic acid ester, polyvinyl butyral, polystyrol and copolymers thereof; polyamide resin, silicone resin, petroleum resin, terpene resin, ketone resin and cumaron resin.

These polymeric materials may be sued after they were dissolved in an solvent such as water, alcohol, ketone, ester, hydrocarbon, etc., or after they were emulsified or dispersed in water or a solvent other than water. Further, sensitizer can be added thereto, and includes, for example, fatty acid amides such as stearic acid amide, palmitic acid amide; ethylenebisamide; montan wax; polyethylene wax; dibenzyl terephthalate; benzyl p-benzyloxybenzoate; di-p-tolyl carbonate; p-benzylbiphenyl; phenyl -naphthylcarbonate; 1,4-diethoxynaphthalene; 1-hydroxy-2-naphthoic acid phenyl ester; 1,2-di(3-methyl-phenoxy) ethane; bis(2-(4-methoxy phenoxy)ethyl)ether; dibenzyl-4,4'-ethylene dioxybenzoate; m-terphenyl; and the like.

Further, metal salts (Ca, Zn salts) of p-nitrobenzoic acid or metal salts (Ca, Zn-salts) of monobenzylphthalate, which are well-known stabilizers, can be added thereto in the range which does not deteriorate the offects of the present invention. The kinds and the amount of organic color-developing agent, colorless basic dyestuff, stabilizer and other ingredients which are used in the present invention, are determined depending upon the performance and recording aptitude required for the recording material, and are not otherwise limited. However, in ordinary cases, it is suitable to use 1-12 parts by weight of organic color-developing agent, 0.1-1 part by weight of stqabilizer and 1-20 parts by weight of filler, based on 1 part by weight of colorless basic dyestuff and to add 10-25% by weight of a binder in total solid content.

The aimed heat-sensitive recording material may be obtained by coating the above coating composition on a substrate such as papers, synthetic papers, films, plastics and the like.

The organic color-developing agent, the colorless basic dyestuff, the stabilizer and if necessary, other ingredients are ground to a particle size of several microns or smaller by means of a grinder such as a ball mill, attritor, sand grinder etc., or an appropriate emulsifier, and then binder and various additives in accordance with the purpose, are added thereto to prepare a coating material. Further, an over-coating layer composed of a polymeric substance can be superposed on the heat-sensitive layer for the purpose of improving the preservability.

The reason why the effects of the present invention are obtained is assumed as follows.

The reason for providing a superior dynamic color-formation is due to a rapid melting dissolution-diffusion of the stabilizer and a great saturation-solubility of the stabilizer. Accordingly, the instantaneous contact with a high-temperature thermal head forms a recording image.

On the other hand, the reason for the prevention of the undesirable color-formation under a long contact with a low-temperature substance is due to the combined use of a phenolic substance having a melting point of at least 180° C., resulting in the difficulty of causing a melting-point depression for forming a color, under a long contact with the heated substance of circa 80° C.

Further, the recording material of the present invention forms a colored composition rapidly in a physical-chemical reaction of an organic color-developing agent, stabilizer and leuco dyestuff upon heating, and the formed composition is difficult in dissolving in oily substances such as hair oil, fats, etc. For these reasons, the recording materials are superior in oil resistance. Still more, the stabilizer selected in 01 the present invention has a solubility of less than 0.05 g per 100 g water. That is, the solubility of the stabilizer is samll, and thus the solubility the colored composion in water is small.

Accordingly, the recording material of the present invention is superior in water resistance.

EXAMPLES

The physical properties of the stabilizers used in Examples and Comparative Examples are indicated in Table 1. The phenolic substances of the group A, those of the present invention have both a melting point of at least 180° C. and a solubility of less than 0.05 g per 100 g water. The phenolic substances of the group B have a melting point of less than 180° C. The phenolic substances of the group C have a solubility of at least 0.05 g per 100 g water.

Hereinafter, the present invention will be described by Examples and Comparative Examples. Unless otherwise indicatied, all parts are by weight.

EXAMPLES 1-6

Solution A

Dispersion of Dyestuff 3-n-dibutylamino-6-methyl-7-anilinofluorane—2.0 parts
10% aqueous solution of polyvinyl alcohol—4.6 parts
water—2.5 parts

Solution B

Dispersion of Color-Developing Agent color-developing agent (see Table 2)—6 parts
10% aqueous solution of polyvinyl alcohol—18.8 parts
water—11.2 parts

Solution C

Dispersion of Stabilizer stabilizer(see Table 2)—2.0 parts
10% aqueous solution of polyvinyl alcohol—2.5 parts
water—1.5 parts Each of the solutions of the above-mentioned compositions was ground to a particle size of 1μ by means of a sand grinder. Then, the dispersions were mixed in following proportion to prepare a coationg material.

Solution A(dispersion of dyestuff)—9.1 parts
Solution B(dispersion of color-developing agent)—36 parts
solution C(dispersion of stabilizer)—6 parts
Kaolin clay(50% aqueous dispersion)—12 parts The coating material was applied on one side of the base paper weighing 50 g/m$^2$ in a coating weight of 6.0 g/m$^2$ and then was dried.

The resultant sheet was treated to a smoothness of 400-500 sec. by means of a supercalender.

In this manner, the black-color-forming heat-sensitive recording sheets of Examples 1-6 were obtained.

COMPARATIVE EXAMPLE 1

A heat-sensitive recording sheet was prepared in the same manner as Example without using solution C.

COMPARATIVE EXAMPLES 2-8

Solution A

Dispersion of Dyestuff 3-n-dibutylamino-6-methyl-7-anilinofluorane—2.0 parts
10% aqueous solution of polyvinyl alcohol—4.6 parts
water—2.5 parts

Solution B

Dispersion of Color-Developing Agent

Coloer-developing agent(see Table 2)—6 parts
10% aqueous solution of polyvinyl alcohol—18.8 parts
water—11.2 parts

Solution C

Dispersion of Stabilizer

Stabilizer (see Table 2)—2.0 parts
10% aqueous solution of polyvinyl alcohol—2.5 parts
water—1.5 parts Each of the sokutions of the above-mentioned compositions was ground to a particle size of 1μ by means of a sand grinder. Then, the dispersions were mixed in following proportion to prepare a coating material.

Solution A(dispersion of dyestuff)—9.1 parts
Solution B(dispersion of color developing agent)—36 parts
Solution C(dispersion stabilizer)—6 parts
Kaolin clay(50% aqueous dispersion)—12 parts The coationg material was applied on one side of the base paper weighing 50 g/m$^2$ in a coating weight of 6.0 g/m$^2$, and then was dried. The resultant sheet was treated to a smoothness of 400-500 sec. by means of a supercalender.

In this manner, the black-color-forming heat-sensitive recording sheets of Comparative Examples 2-8 were obtained.

The heat-sensitive recording sheets obtained by Examples and Comparative Examples were tested for the qualities described hereinafter, and the test results were summarized in Tables 2-3.

(1) Dynamic image density

A heat-sensitive recording sheet is recorded with an impressed voltage of 18.03 Volt and a pulse width of 3.2 milli-seconds by using the thermal facsimile KB-4800 manufactured by TOSHIBA CORPORATION, and the optical density of the recorded image is measured by a Macbeth densitometer (RD 914, using amber filter, which is used in other samples).

(2) Heat resistance

A heat-sensitive recording sheet is pressed down for 3 minutes under a pressure of 10 g/cm$^2$ on a hot plate heated at 80° C., and the optical density is measured by a Macbeth densitometer.

(3) Water resistance

The heat-sensitive recording paper printed in Note (1) is immersed in water of 20° C. for 24 hours, and then dried. The optical density of the recorded part after water-treatment. Residual rate is calculated from the following equation.

$$\text{Residual rate} = \frac{\text{Image density after water treatment}}{\text{Image density before water treatment}} \times 100(\%)$$

(4) Oil resistance

The heat-sensitive recording paper printed in Note (1) is immersed in a salad oil for 5 hours, and washed off with a filter paper. The optical density of the recorded part after oil treatment is measured by a Macbeth densitometer. Residual rate is calculated from the following equation.

$$\text{Residual rate} = \frac{\text{Image density after oil treatment}}{\text{Image density before oil treatment}} \times 100(\%)$$

TABLE 1

| | physical properties of stabilizer | | |
|---|---|---|---|
| | Stabilizer | Melting point (°C.) | solubility to water |
| A | Bis(3-t-butyl-4-hydroxy-6-methyl phenyl) sulfone | 255 | 0.005 g/100 g |
| | 4,4'-sulfinylbis(2-t-butyl 5-methyl phenol) | 181 | 0.010 g/100 g |
| | 4,4'-Butylidenebis(3-methyl-6-t-butyl phenol) | 210 | 0.012 g/100 g |
| | 1,1,3-tris(2-methyl-4-hydroxy-5-t-butyl phenyl)butane | 186 | 0.003 g/100 g |
| | 1,1,3-tris(2-methyl-4-hydroxy-5-cyclohexyl phenyl)butane | 221 | 0.002 g/100 g |
| | Bis(3,5-dibromo-4-hydroxy phenyl sulfone | 285 | 0.015 g/100 g |
| B | 4,4'-Isopropylidene diphenol | 155 | — |
| | P-Hydroxybenzyl benzoate | 110 | — |

TABLE 1-continued

| | Stabilizer | physical properties of stabilizer: Melting point (°C.) | solubility to water |
|---|---|---|---|
| C | 4,4'-Dihydroxy diphenyl sulfone | — | 0.25 g/100 g |
| | 4,4'-Dihydroxy diphenyl sulfide | — | 0.20 g/100 g |

TABLE 2

| | Test results: Color developing agent | Stabilizer | Dynamic image density (1) |
|---|---|---|---|
| Example | | | |
| 1 | 4-Hydroxy-4'-n-propoxy diphenyl-sulfone | Bis(3-t-butyl-4-hydroxy-6-methyl phenyl)sulfone | 1.35 |
| 2 | 4-Hydroxy-4'-n-propoxy diphenyl-sulfone | 4,4'-Sulfinyl bis(2-t-butyl-5-methlphenol) | 1.34 |
| 3 | 4-Hydroxy-4'-n-propoxy diphenyl-sulfone | 4,4'-Butylidene bis(3-metyl-6-t-butylphenol | 1.35 |
| 4 | 4-Hydroxy-4'-n-propoxy diphenyl-sulfone | 1,1,3-tris(2-methyl-4-hydroxy-5-t-butyl phenyl) butane | 1.34 |
| 5 | 4-Hydroxy-4'-n-propoxy diphenyl-sulfone | 1,1,3-tris(2-methyl-4-hydroxy-5-cyclohexyl phenyl)butane | 1.34 |
| 6 | 4-Hydroxy-4'-n-propoxy diphenyl-sulfone | Bis(3,5-dibromo-4-hydroxy phenyl) sulfone | 1.35 |
| Comparative Example | | | |
| 1 | 4-Hydroxy-4'-n-propoxydihenyl-sulfone | No addition | 1.30 |
| 2 | 4-Hydroxy-4'-methyl dipheny sulfone | 1,1,3-tris(2-methyl-4-hydroxy-5-cyclohexylphenyl)butane | 1.29 |
| 3 | 4-Hydroxy-4'-isopropoxy diphenyl sulfone | 4,4'-Butylidenebis(3-methyl-6-t-butylphenol) | 1.30 |
| 4 | 4-Hydroxy-4'-n-butoxy diphenyl sulfone | Bis(3,5-dibromo-4-hydroxyphenyl) sulfone | 1.30 |
| 5 | 4-Hydroxy-4'-n-propoxydiphenyl sulfone | 4,4'-Isopropylidene diphenol | 1.32 |
| 6 | 4-Hydroxy-4'-n-propoxydiphenyl sulfone | p-Hydroxyl benzyl benzoate | 1.30 |
| 7 | 4-Hydroxy-4'-n-propoxydiphenyl sulfone | 4,4'-Dihydroxy diphenylsulfone | 1.29 |
| 8 | 4-Hydroxy-4'-n-propoxydiphenyl sulfone | 4,4'-Dihydroxy diphenyl sulfide | 1.30 |

TABLE 3

| | Test results: Heat resistance (2) | | Water resistance (3) | | | Oil resistance (4) | | |
|---|---|---|---|---|---|---|---|---|
| | Before | After | Before | After | Residual rate | Before | After | Residual rate |
| 1 | 0.06 | 0.07 | 1.35 | 1.24 | 92 | 1.35 | 1.28 | 95 |
| 2 | 0.06 | 0.07 | 1.34 | 1.22 | 91 | 1.34 | 1.30 | 97 |
| 3 | 0.06 | 0.07 | 1.35 | 1.24 | 92 | 1.35 | 1.29 | 96 |
| 4 | 0.06 | 0.07 | 1.34 | 1.24 | 93 | 1.34 | 1.28 | 96 |
| 5 | 0.06 | 0.07 | 1.34 | 1.23 | 92 | 1.34 | 1.30 | 97 |
| 6 | 0.06 | 0.07 | 1.35 | 1.27 | 94 | 1.35 | 1.29 | 96 |
| 1 | 0.06 | 0.07 | 1.30 | 0.65 | 50 | 1.30 | 0.78 | 60 |
| 2 | 0.06 | 0.28 | 1.29 | 1.08 | 84 | 1.29 | 1.19 | 92 |
| 3 | 0.06 | 0.28 | 1.30 | 1.08 | 83 | 1.30 | 1.21 | 93 |
| 4 | 0.07 | 0.45 | 1.30 | 1.07 | 82 | 1.30 | 1.17 | 90 |
| 5 | 0.12 | 0.68 | 1.32 | 0.78 | 59 | 1.32 | 0.86 | 65 |
| 6 | 0.10 | 0.80 | 1.35 | 0.81 | 60 | 1.35 | 0.86 | 64 |
| 7 | 0.15 | 0.50 | 1.29 | 0.71 | 55 | 1.29 | 0.77 | 60 |
| 8 | 0.15 | 0.49 | 1.30 | 0.71 | 55 | 1.30 | 0.79 | 61 |

The heat-sensitive recording sheet of the present invention has the following advantages.

(1) Owing to excellent thermal responsibility, an intense, clear image is obtained in the recording at a high speed and high density.

(2) The color-formation hardly occurs in applying onto a fried food lapped by a vinylchloride film, etc.

(3) The printed parts (colored parts) hardly disappear in the contact with a plasticizer, salad oil, vinegar etc.

(4) The printed parts hardly disappear when they are contacted with water.

We claim:

1. A heat-sensitive recording material comprising a substrate having thereon a color-developing layer which comprises at least one colorless or pale colored basic chromogenic dyestuff and an organic color-developing agent, said organic color-developing layer comprising both 4-hydroxy-4'-n-propoxydiphenylsulfone as a color-developing agent and at least one stabilizer selected from the group consisting of bis (3-t-butyl-4-hydroxy-6-methyl-phenyl) sulfone, 4,4'-sulfinylbis(2-t-butyl-5-methylphenol), 4,4'-butylidene bis (3-methyl-6-butylphenol), and bis (3,5-dibromo-4-hydroxyphenyl) sulfone.

2. The heat-sensitive recording material according to claim 1, wherein said dyestuff is selected from the group consisting of triphenylmethane dyestuff, fluorane dyestuff, azaphtalide dyestuff and fluorene leuco dyestuff.

3. The heat-sensitive recording material according to claim 1, wherein said color-developing layer comprises 1-12 parts by weight of organic color-developing agent, 0.1-1 part by weight of stabilizer and 1-20 parts by weight of filler, based on 1 part by weight of basic colorless dyestuff and 10-25% by weight of a binder in total solid content.

4. The heat-sensitive recording material according to claim 1, wherein said color-developing layer comprises further a sensitizer.

5. The heat-sensitive recording material according to claim 1, wherein said substrate is at least one substance selected from the group consisting of papers and synthetic papers.

6. The heat-sensitive recording material according to claim 1, wherein said substrate is a plastic film.

7. The heat-sensitive recording material according to claim 1, wherein an over-coating layer composed of a polymeric substance is superposed on said heat-sensitive layer.

* * * * *